United States Patent [19]

Oakes

[11] 4,069,947

[45] Jan. 24, 1978

[54] ADAPTORS

[75] Inventor: Malcolm Campbell Oakes, Wilmslow, England

[73] Assignee: Taymar Limited, Stockport, England

[21] Appl. No.: 641,380

[22] Filed: Dec. 17, 1975

[30] Foreign Application Priority Data

Dec. 19, 1974 United Kingdom ..... 55328/74
May 30, 1975 United Kingdom ..... 23562/75

[51] Int. Cl.[2] ..... B67B 7/24
[52] U.S. Cl. ..... 222/5; 285/87
[58] Field of Search ..... 222/5, 83.5, 153, 81–83, 222/85, 86, 88, 103, 105, 106; 151/41.74; 220/288, 315, 316; 251/95, 101, 105; 285/87, 317

[56] References Cited

U.S. PATENT DOCUMENTS

| | | | |
|---|---|---|---|
| 1,648,130 | 11/1927 | Jarvis | 220/288 |
| 2,601,211 | 6/1952 | Neely | 222/5 |
| 2,890,815 | 6/1959 | Corlet | 222/5 |
| 3,807,774 | 4/1974 | Heath | 285/87 |
| 3,905,755 | 9/1975 | Aske | 222/5 X |
| 3,938,704 | 2/1976 | Milgram | 222/5 |

*Primary Examiner*—Drayton E. Hoffman
*Assistant Examiner*—Fred A. Silverberg
*Attorney, Agent, or Firm*—Fleit & Jacobson

[57] ABSTRACT

There is disclosed an adaptor which enables a gas-consuming tool or appliance, for example a blowlamp or a light, to be attached to a puncturable gas cartridge.

The adaptor comprises a main body part defining a through passage, a valve member which may be moved from a position in which the through passage is closed to a position in which this passage is open, means for urging the valve member into a closed position, a piercing member, means for creating a seal between the adaptor and a gas cartridge, and means for urging the adaptor and a gas cartridge together.

The adaptor includes a housing into which in operation a gas cartridge is received and which is apertured at its top to allow insertion of the main body part.

17 Claims, 5 Drawing Figures

ADAPTORS

The present invention relates to adaptors for enabling gas appliances such as for example a blowlamp to be interchangeably connected to puncturable gas cartridges containing for example butane.

There are many different gas consuming appliances which may be run off a puncturable butane gas cartridge. All of these appliances comprise a piercing member which is pushed into the top of the cartridge when the appliance is fixed to the cartridge to allow the gas to flow out through the appliance. To prevent gas escaping a gas-tight seal is made between the appliance and the cartridge when the appliance is fixed to the cartridge. Once the appliance is fixed to a particular cartridge, the appliance cannot be removed from the cartridge before the cartridge is empty without loss of the gas remaining in the cartridge. Thus when another appliance is to be used, it will be necessary to provide another cartridge. Where several different appliances are being used in a given short period of time, it will therefore be necessary to have opened an equivalent number of gas cartridges.

Self-sealing gas containers are also known to which appliances may be detachably connected, the action of attaching the appliance opening a valve integrally formed in the top of the container. With these containers the valve in the container automatically closes when the appliance is removed and the appliances are therefore interchangeable.

According to the invention an adaptor comprises a main body part defining a through passage, a valve member which may be moved from a position in which the through passage is closed to a position in which this passage is open, means for urging the valve member into a closed position, a piercing member, means for creating a seal between the adaptor and a gas cartridge, and means for urging the adaptor and a gas cartridge together.

In order that the invention may be more fully understood, one embodiment of the invention will now be described, by way of example, with reference to the accompanying drawings, in which.

Figure 1:
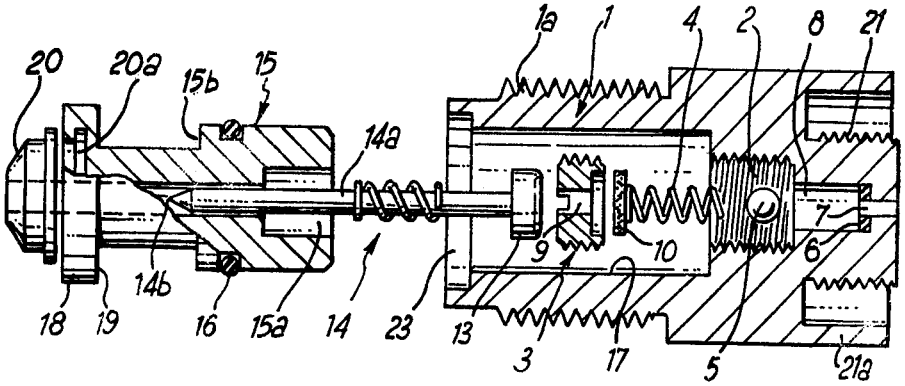
FIG. 1 shows an exploded view in partial section of a constituent element of an adaptor.
Figure 1A:
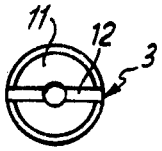
FIG. 1A shows a plan view of a member of the element of FIG. 1.
Figure 2:
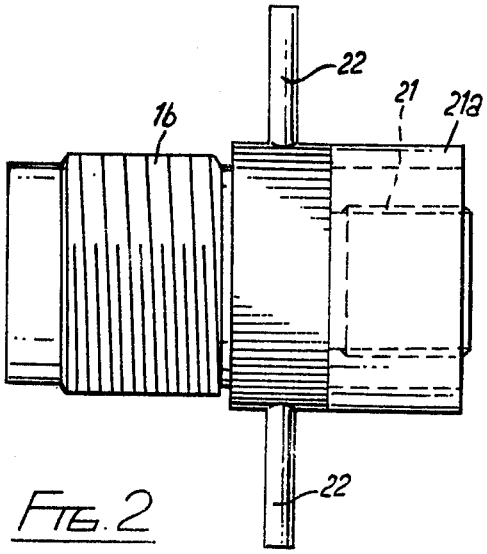
FIG. 2 shows an external view of the main body part of the adaptor.
Figure 4:
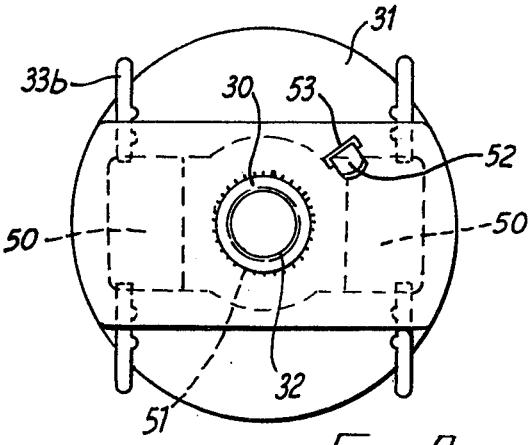
FIG. 4 shows a plan view of the housing of FIG. 3.

The adaptor comprises two basic constituent elements, the element shown in FIG. 1 and the element shown in FIG. 4. The element shown in FIG. 1 comprises a main brass body part 1 through which a stepped passage extends. A portion 2 of the passage has an internally screwthreaded wall and a complementary externally screwthreaded member 3 is screwed into this portion. A spring 4 of stainless steel is constrained between the member 3 and a stainless steel ball 5 which constitutes the valve member and which seats on a sealing neoprene washer 6 which surrounds the outlet port 7 of a further portion 8 of the through passage extending from the portion 2. The member 3 has a recessed face 9 to receive a flat circular gauze filter 10 and one end of the spring 4. The other face 11 of the member 3 (see FIG. 1A) has a diametric slot 12 to enable the member 3 to be screwed with a screwdriver into the portion 2 of the through passage and to receive the flat head 13 of a T-shaped piercing member 14 also made of stainless material, and having a pointed tip 14*b*. This piercing member 14 extends into a further passage portion defined by a further generally cylindrical member 15. A stainless spring surrounds the flat shank 14*a* of the piercing member 14 and is constrained to act between the member 15 and the head 13, being received in a recess 15*a* in the end of the member 15. The member 15 is provided with an external neoprene 'O' ring 16 which provides a seal between this member and the internal wall of the passage portion 17 defined by the body part 1. A stainless metal ring 18 forms an integral part of the stepped member 15 and has a shoulder 19. A circlip (not shown) is received in peripheral slot (not shown) in a recess 23 formed in the open end of the portion 17 to hold the member 15 in the portion 17 by abutment against shoulder 15*b* on member 15. The member 15 is provided, in its end remote from the ring 16, with a sealing neoprene apertured washer 20 which seats in an undercut recess 20*a* in the outer end of the member 15.

Figure 3:
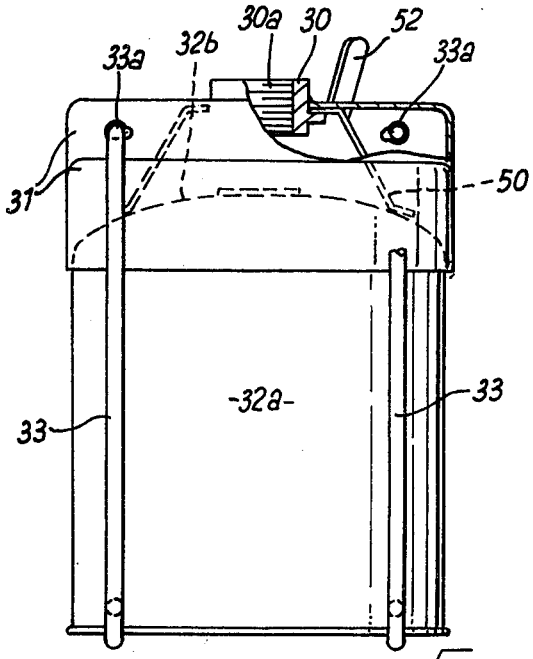
FIG. 3 shows a side view of a housing, part cut away and part in section, to which the element of FIG. 1 is attached.

The main body part 1 is provided at its end remote from the washer 20 with an externally screwthreaded boss 21 which is adapted to fit into a complementary screwthreaded recess in a gas consuming appliance. The threads on the boss 21 are protected by a surrounding skirt portion 21*a*. Two bars 22 extend radially externally of the body part to facilitate it being manually rotated. That part 1*a* of the body part 1 defining the portion 17 is externally screwthreaded at 1*b*. This main body part 1 is adapted to be screwed into a brass boss 30 (FIG. 3), which has an internal screwthread 30*a* complementary to the external screwthread of the body part 1*a* defining portion 17. This boss 30 is fixed in an aperture defined by a housing 31 by means of a crimped washer 32. A pair of U-shaped holders 33 have the ends of their legs inturned at 33*b* and received in apertures in the housing 31 so that the holders are pivotally mounted at 33*a* in the housing 31, so that a gas cartridge 32*a*, the top part of which is received within the housing 31, may be held therein. The leg portions 33*b* are crimped to prevent undesired separation of the holders from the housing. To hold such a cartridge firmly a pair of leaf springs 50 extend on opposite sides respectively of the aperture internally of the housing 31. As shown, the leaf springs 50 may be integral with each other and extend from a central aperture 51 which embraces the inner end of the boss 30.

A releasable detent is provided. This takes the form of a spring tongue 52 integral with and extending upwardly from an edge of a leaf spring 50. The tongue 52 extends through an aperture 53 in the top of the housing 31. The tongue 52 is so located that, when the adaptor is rotated to attach the thread 21 to the boss 30, the bars 22 engage the tongue 52 which yields to allow the parts to become attached. Should inadvertently the adaptor be rotated in a direction tending to detach it from the boss 30, and thus the gas cartridge, with possible unwanted escape of gas, a bar 22 will engage the tongue 52 and prevent rotation. The adaptor cannot be detached from the cartridge without a conscious decision to depress the tongue 52 out of the path of the bars 22.

In operation the housing part illustrated in FIG. 4 is fixed over a gas cartridge and the element of FIG. 1 assembled as described is screwed into the boss 30 until the sealing washer 20 makes sealing contact with the top of the cartridge and the piercing member 14 pierces the top 32*b* of the cartridge. After piercing, gas passes from the cartridge through the passage portions in the parts 15 and 1 but cannot escape from the part 1 as the ball 5 is in the closed position. A gas-consuming appliance may then be screwed over the boss 21 and a valve-operating stem forming part of this appliance is inserted at the same time into the passage through the boss 21 to displace the ball 5 against the action of the spring 4 and thus allow gas to flow to the appliance. If it is desired to change appliances, the appliance is simply unscrewed and the ball 5 will move to the closed position under the action of the spring 4. A new appliance can then be screwed on. Also these appliances, which with the adaptor described above can be interchangeably used with puncturable gas cartridges, can also be used with the conventional self-sealing cartridge. As a result, considerable flexibility in the use of different forms of gas cartridges with different appliances such as blowlamps, lamps, heaters and stoves is introduced.

The releasable detent may take other forms. For example, the detent may comprise an L-section member, one leg being riveted to the top of the housing and the other leg being flexible and upstanding to provide a yieldable tongue. Alternatively, an upstanding pin may be biassed upwardly from the housing and can be depressed to allow rotation of the adaptor.

It will be appreciated that the threads 1*a* are means for urging together the adaptor of FIG. 1 and a gas cartridge. The housing shown in FIG. 4 takes the form of a cap for overlying the top of the cartridge and providing a threaded part 30 with which the threads 1*a* can co-operate. Normally the tip of the piercing member 14*a* is within the seal 20 but rotation of the adaptor moves the part 15 further into the recess 17 against the spring surrounding the piercing member to cause its tip 14*b* to extend beyond the seal 20 and puncture the cartridge.

The springs 50 hold the bottom of the cartridge against the bottoms of the holders 33. The holder bottoms may be accommodated in slots in a plate-like support stand which may have an upwardly facing recess for receiving the bottom of a conventional self-sealing gas container.

I claim:

1. An adaptor for use with gas cartridges comprising a main body part defining a through passage, a valve member which may be moved from a position in which the through passage is closed to a position in which this passage is open, means for urging the valve member in a first direction into a closed position, a piercing member for puncturing the gas cartridge in a direction opposite said first direction, means for creating a seal between the adaptor and the gas cartridge, including external screw threads located on the main body part, and a housing for receiving the gas cartridge and co-operable with the external threads for urging the adaptor and the gas cartridge together.

2. An adaptor as claimed in claim 1, in which the valve member comprises a ball.

3. An adaptor as claimed in claim 2, in which the ball seats on a neoprene ring.

4. An adaptor as claimed in claim 3, in which the means for urging the valve member into a closed position is a spring.

5. An adaptor as claimed in claim 4, in which the spring is constrained to act between the ball and an externally screwthreaded member screwed into an internally screwthreaded recess defining part of the through passage.

6. An adaptor as claimed in claim 5, in which the externally screwthreaded member is slotted to receive the head of the piercing member.

7. An adaptor as claimed in claim 1, and comprising a housing into which in operation a gas cartridge is received and which is apertured at its top to allow insertion of the main body part.

8. An adaptor as claimed in claim 7, in which a boss is received in the aperture and is internally screwthreaded and the main body part is externally screwthreaded in a complementary manner.

9. An adaptor as claimed in claim 1, in which the main body part has an externally screwthreaded boss at its outlet end to cooperate with a complementary internally screwthreaded recess of an appliance.

10. An adaptor as claimed in claim 9, in which the main body part has a skirt surrounding and spaced from the externally screwthreaded boss to protect the threads.

11. An adaptor as claimed in claim 1, in which the through passage includes an outlet in an externally threaded portion of the main body part which includes a skirt surrounding and spaced from the threaded portion to protect the threads.

12. An adaptor as claimed in claim 1, including a housing into which in operation a gas cartridge is received and which is apertured to allow insertion of the main body part of the adaptor, a boss being received in the aperture, the boss being internally screwthreaded in a complementary manner, and a releasable detent for resisting undesired rotation of the main body part comprising a flexible tongue which extends through an aperture in the housing and is attached to a spring for biasing the cartridge away from the housing.

13. An adaptor as claimed in claim 1, in which the means for urging together the adaptor and a gas cartridge comprises external threads on the main body part and further including a housing for receiving a gas cartridge and co-operable with the external threads.

14. An adaptor as claimed in claim 1, in which the housing receives an upper marginal portion of the cartridge.

15. An adaptor as claimed in claim 13, including a releasable detent mounted on said housing and being co-operable with the main body part to resist movement of the piercing member towards the cartridge.

16. An adaptor as claimed in claim 15, in which the detent comprises a flexible tongue.

17. An adaptor as claimed in claim 16, including a pair of diametrically opposed bars extending externally of the adaptor to facilitate rotation of the adaptor and to cooperate with said flexible tongue to form said detent.

* * * * *